United States Patent [19]

Gurries

[11] 4,353,175

[45] Oct. 12, 1982

[54] RESONANTLY DRIVEN TRENCHING TOOL

[75] Inventor: Raymond A. Gurries, Reno, Nev.

[73] Assignee: Resonant Technology Company, Sparks, Nev.

[21] Appl. No.: 155,739

[22] Filed: Jun. 2, 1980

[51] Int. Cl.[3] ..... A01B 35/00; E02F 5/02

[52] U.S. Cl. ..... 37/101; 37/DIG. 18; 172/40

[58] Field of Search ..... 37/DIG. 18, 141 R, 99, 37/101, 102; 172/40; 299/14

[56] References Cited

U.S. PATENT DOCUMENTS

| | | | |
|---|---|---|---|
| 3,145,488 | 8/1964 | French | 37/DIG. 18 |
| 3,245,159 | 4/1966 | MacDonald | 37/108 R X |
| 3,392,464 | 7/1968 | MacDonald | 37/101 |
| 3,590,927 | 7/1971 | Brouwer et al. | 37/101 X |
| 3,633,683 | 1/1972 | Shatto, Jr. | 37/DIG. 18 |
| 4,257,648 | 3/1981 | Bodine | 172/40 X |

FOREIGN PATENT DOCUMENTS

| | | | |
|---|---|---|---|
| 971580 | 7/1975 | Canada | 37/DIG. 18 |
| 1104429 | 4/1961 | Fed. Rep. of Germany | 37/DIG. 18 |
| 1484663 | 3/1969 | Fed. Rep. of Germany | 37/DIG. 18 |
| 597471 | 8/1959 | Italy | 37/DIG. 18 |

*Primary Examiner*—Clifford D. Crowder

*Attorney, Agent, or Firm*—Townsend and Townsend

[57] ABSTRACT

A resonantly driven tool for forming a trench in base material is disclosed. A channel member is adapted to be aligned with the path of the trench to be formed. The channel member has a floor inclined upwardly toward the rear, and oppositely disposed sides projecting upwardly from the floor. The channel member is open front and rear, and the channel member is advanced along the path of the trench to be formed. A cutting blade is located at the leading end of the floor of the channel member, and is mounted so that it can reciprocate relative to the channel member. The cutting blade engages the material in which the trench is to be formed as the channel member is advanced. A resonant system is provided with an output vibratory in at least near resonance. The resonant system is supported to move with the channel member, and is operatively coupled to the cutting blade to drive the cutting blade intermittently forwardly. The resonantly driven cutting blade thus dislodges the material, and the dislodged material is excavated by the channel member to form the trench.

16 Claims, 4 Drawing Figures

RESONANTLY DRIVEN TRENCHING TOOL

BACKGROUND OF THE INVENTION

The present invention relates to trenching tools, and in particular to a trenching tool which is resonantly driven to dislodge the material in which the trench is being formed.

A variety of different types of trenching techniques have been used in forming different types of trenches. A steam shovel or back hoe may be used to form a deep trench, but such techniques are not commercially practical where long, continuous shallow trenches are to be dug. In such latter situations, it is desirable to provide a tool which scoops up the material to form the trench in a continuous fashion. Typically, a rotating scoop is employed having a plurality of scoop elements mounted on a rotating member. Unfortunately, such devices often become snagged when encountering obstacles such as roots, rock formations and the like, greatly compromising their utility as trenching tools.

SUMMARY OF THE INVENTION

The present invention provides a resonantly driven tool for forming a trench in base material. A channel member is adapted to be aligned with the path of the trench to be formed. The channel member has a floor inclined upwardly toward the rear, and oppositely disposed sides projecting upwardly from the floor. The channel member is open front and rear, and the channel member is advanced along the path of the trench to be formed.

A cutting blade is located at the leading end of the floor of the channel member, and is mounted so that it can reciprocate relative to the channel member. The cutting blade engages the material in which the trench is to be formed as the channel member is advanced. A resonant system is provided with an output vibratory in at least near resonance. The resonant system is supported to move with the channel member, and is operatively coupled to the cutting blade to drive the cutting blade intermittently forwardly. The resonantly driven cutting blade thus dislodges the material, and the dislodged material is excavated by the channel member to form the trench.

The trenching tool of the present invention first loosens the material to be excavated, and thereafter removes it to provide the trench. The cutting blade of the present invention is driven intermittently forwardly in a chisel-like fashion, and is thus able to penetrate all but the most extreme obstacle. The material loosened by the resonantly driven cutting blade is simply scooped up by the following channel member to form the trench.

In its preferred form, the present invention provides an anvil plate mounted for reciprocation below the floor of the channel member. The leading edge of the anvil plate is within striking distance of the cutting blade assembly. A matched pair of angulate resonant beams drive the anvil plate against the cutting blade assembly to drive it intermittently forwardly. This construction provides a compact and convenient resonant drive for the cutting blade.

The novel features which are characteristic of the invention, as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
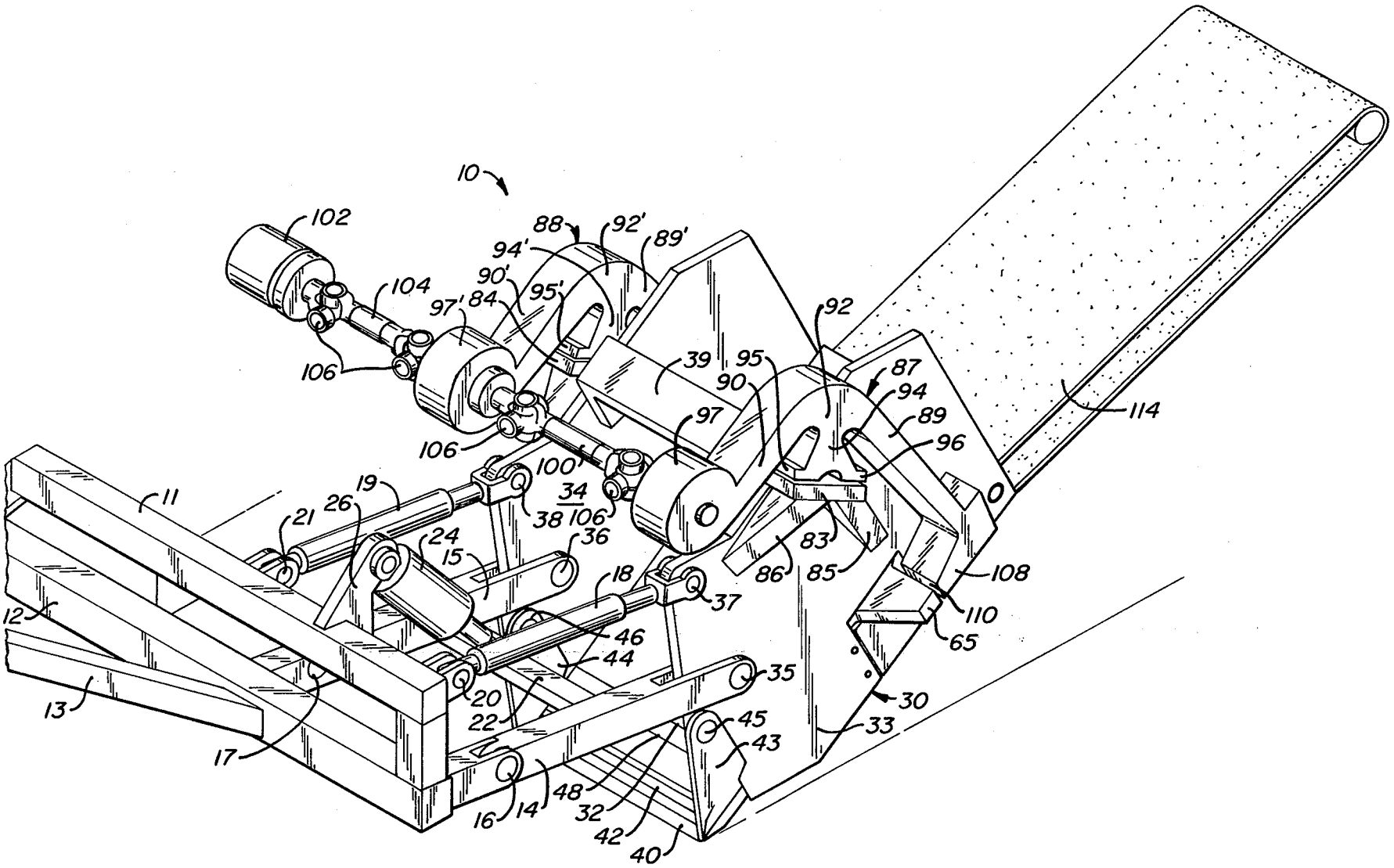
FIG. 1 is a perspective view of the preferred embodiment of the trencher of the present invention.
Figure 2:
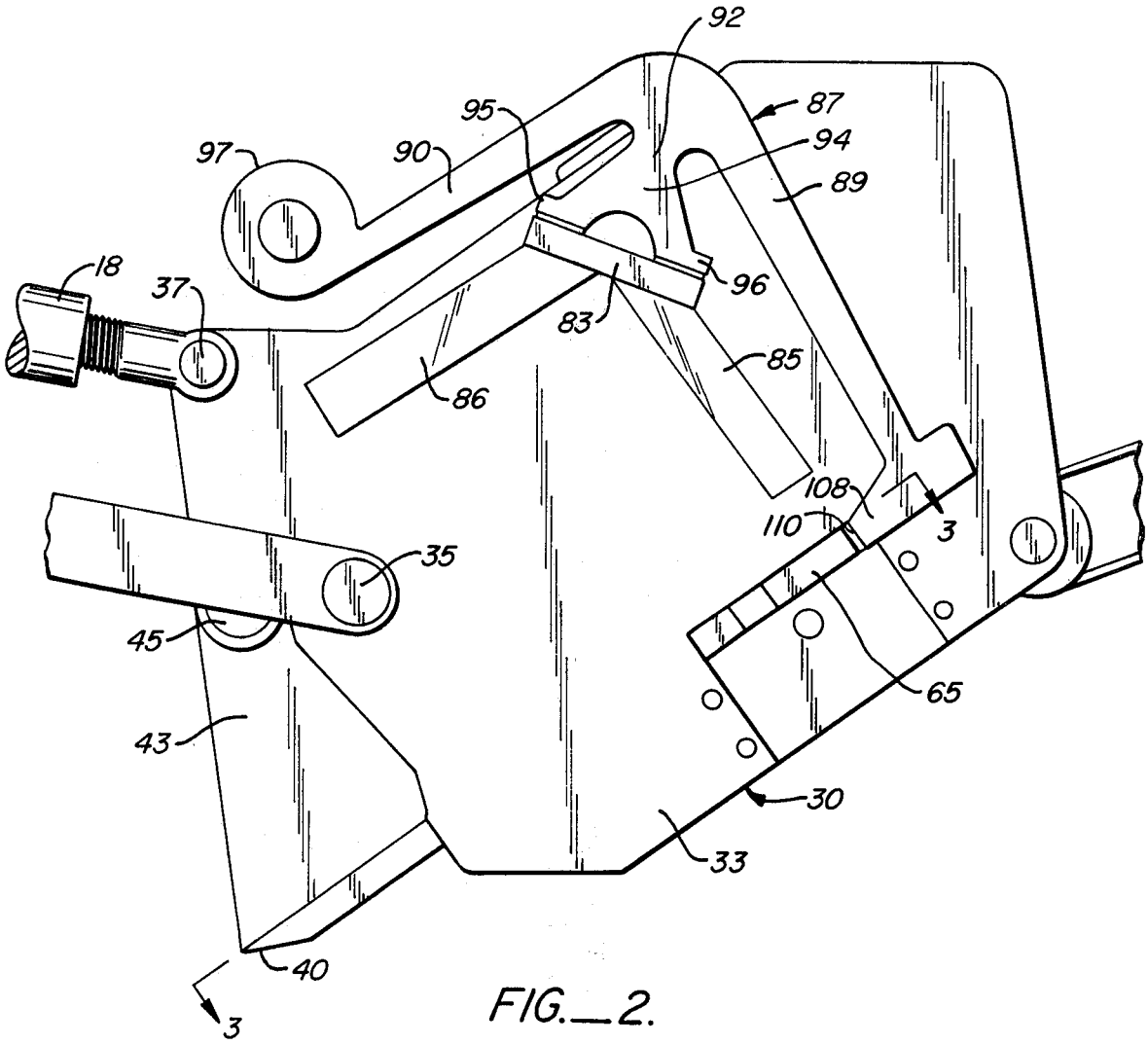
FIG. 2 is a side elevation view of the trencher of FIG. 1.

The preferred embodiment 10 of the trencher of the present invention is illustrated generally by way of reference to FIGS. 1 and 2. A mobile carrier vehicle has a transversely extending frame including parallel members 11, 12 together with a brace 13. A pair of pivot arms 14, 15 project rearwardly from lower frame member 12, and are pivotably attached thereto by pins 16, 17. A pair of axially adjustable members 18, 19 are pivotably attached to upper frame member 11 by pins 20, 21. A transverse bar 22 interconnects frame members 14, 15, and a hydraulic cylinder 24 attached to a flange 26 projecting upwardly from frame member 11 is coupled to bar 22. Arms 14, 15 and adjustable members 18, 19 provide a parallelogram structure, the vertical position of which is controlled by hydraulic cylinder 24. Adjustable members 18, 19 control the orientation of the parallelogram structure.

A channel member 30, including a floor 32, upwardly projecting sides 33, 34 and spacer 39, is supported by the parallelogram structure of arms 14, 15 and members 18, 19. Arms 14, 15 are attached to sides 33, 34 of channel member 30 by pins 35, 36. Adjustable members 18, 19 are attached to sides 33, 34 by pins 37, 38. Channel member 30 is thus supported completely by the frame members 11, 12 emanating from the carrier vehicle and can be vertically positioned by cylinder 24.

A cutter blade element 40 on a cutter assembly 42 is located at the leading end of the floor 32 of channel member 30. Cutter assembly 42 is suspended from a pair of hanger arms 43, 44 pivotably mounted to the respective sides 33, 34 of channel member 30 by pin connections 45, 46. Cutting blade element 40 is thus reciprocatable forwardly and rearwardly relative to channel member 30.

Figure 3:
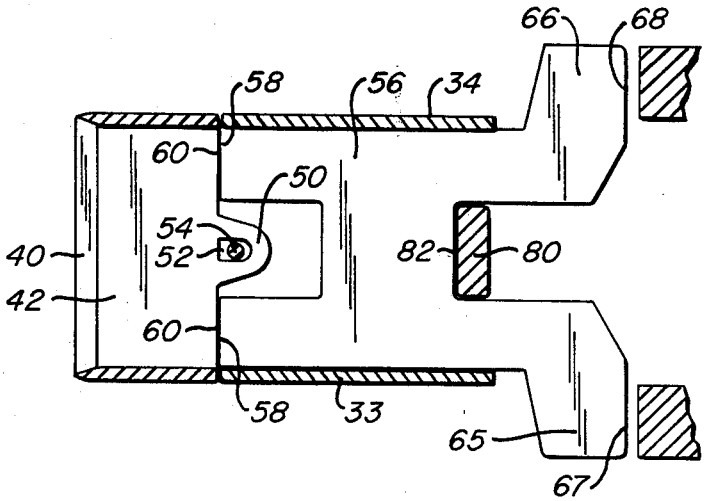
FIG. 3 is a sectional view taken along lines 3—3 of FIG. 2.

Cutting blade assembly 42 has a rearwardly directed central tongue 50 (see FIG. 3). An aperture 52 in tongue 50 circumscribes a post 54 depending from the floor 32 of channel member 30. Forward movement of cutter assembly 42 is thus limited by post 54 engaging aperture 52.

Figure 4:
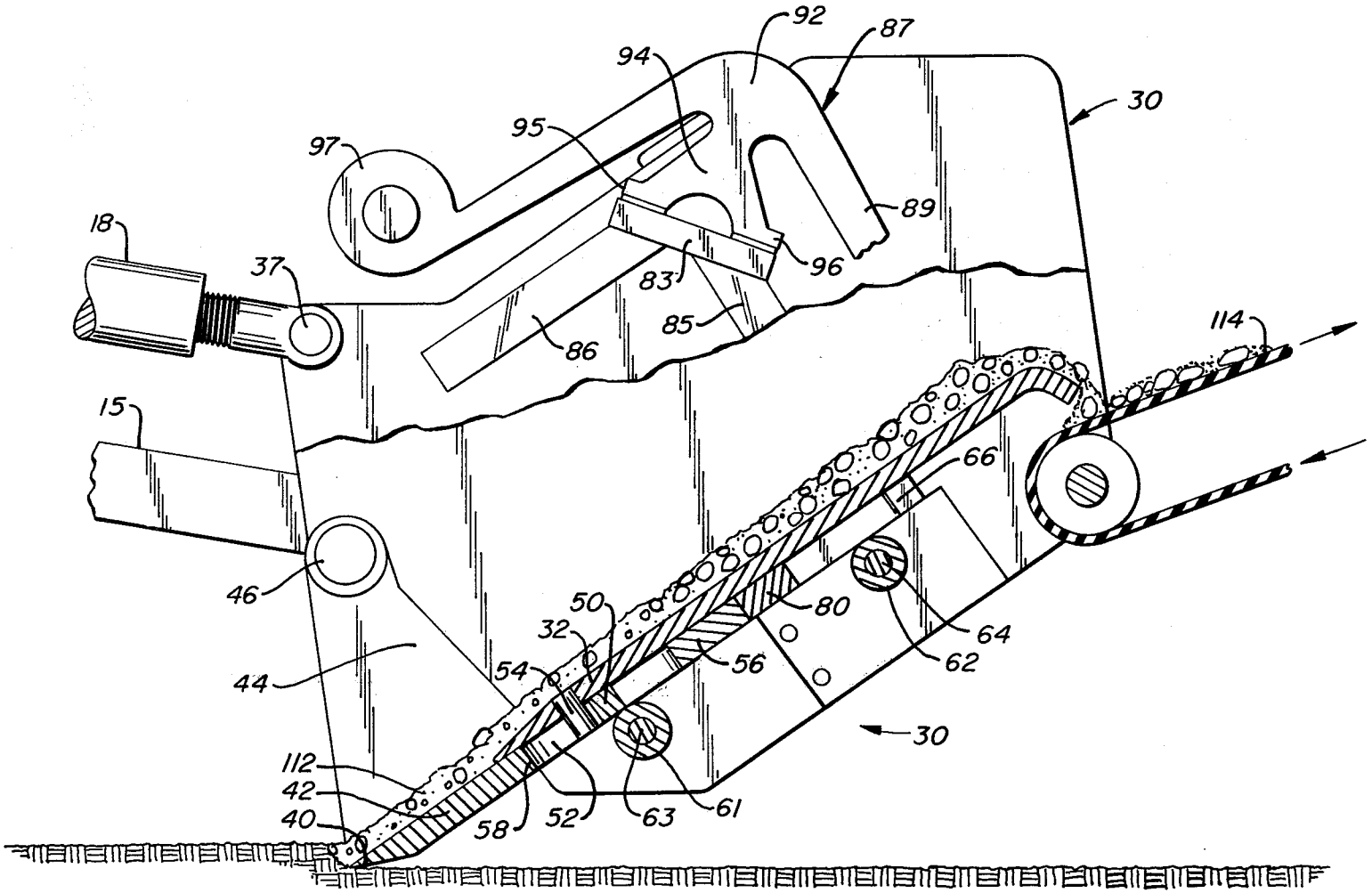
FIG. 4 is a side, partially broken away elevation view of the trencher of FIG. 1.

An anvil plate 56 is provided immediately underlying and parallel to floor 32 (FIG. 4). Anvil plate 56 has a leading edge 58 proximate the trailing edge 60 of cutter blade assembly 42. Anvil plate 56 is supported by transverse rollers 61, 62 on respective shafts 63, 64 which allow the anvil plate to move forwardly and rearwardly with respect to floor 32.

Anvil plate 56 has a pair of oppositely directed tongues 65, 66 extending outwardly beyond the respective sides 33, 34 of channel member 30. The tongues 65, 66 of anvil plate 56 have rearwardly directed striking surfaces 67, 68 respectively. A vertical stop 80 projecting downwardly from floor 32 of channel member 30 engages a back surface 82 of anvil plate 56 to limit rearward movement of the anvil plate.

A pair of support plates 83, 84 are mounted to the exterior surfaces of sides 33, 34 respectively. Each support plate 83, 84 is mounted on a pair of support members such as 85, 86 for structural rigidity.

A matched pair of resonant beams 87, 88 are mounted on the respective support plates 83, 84. Beams 87, 88 are substantially identical and are mirror images of one another, and the elements of beam 88 are given prime numerals corresponding to the numerals designating elements of resonant beam 87.

Each resonant beam 87, 88 is an angulate beam including a pair of legs 89, 90 meeting at a juncture 92 at an angle of approximately 90°. A flange 94 extends inwardly from juncture 92 bisecting legs 89, 90, and terminates in a pair of ears 95, 96 bolted to mounting plate 83. Respective ears 95', 96' of resonant beam 88 are bolted to mounting plate 84.

Beams 87, 88 have integral housings 97, 97' formed at the ends of legs 90, 90', constituting the input ends of the resonant beams. Eccentric weight oscillators, coupled to one another by shaft 100, are located within the respective housings 97, 97'. A motor 102 having an output shaft 104 drives the respective oscillators within housings 97, 97' in unison. The various elements of the drive train are isolated from one another by a series of universal joints 106.

Angulate beams 87, 88 have a resonant frequency with a single central node at the juncture 92, 92' when the beams are restrained at flanges 94, 94'. The opposite ends of legs 89, 90 and 89', 90' are anti-nodes at the resonant frequency. Motor 102 drives the oscillators in housings 97, 98 at at least near, typically slightly less than, the resonant frequency of the beams. As a result, the ends of legs 89, 89' of beams 87, 88, constituting the output ends of the resonant beams, vibrate in a resonant fashion.

The output ends of legs 89, 89' are enlarged to form weighted hammers 108, 108' respectively. The forward surfaces as 110, 110' of hammers 108, 108' are spaced slightly rearwardly from the rear striking surfaces 67, 68 of anvil plate 56 when resonant beams 87, 88 are at rest with the hammers in their neutral position and the anvil plate at its rearmost position. However, upon excitation of the resonant beams to at least near resonance, the forward surfaces 110, 110' of hammers 108, 108' strike surfaces 67, 68 to drive anvil plate 56 forwardly.

As the carrier vehicle moves the trenching tool 10 along the path of the trench to be dug, hammers 108, 108' of resonant beams 87, 88 will intermittently strike anvil plate 56, driving it forwardly against cutter assembly 42. Each impact of hammers 108, 108' will thus drive cutting blade 40 forwardly into the earth to be dislodged to provide the trench. Between each hammer blow, cutter blade assembly 42 moves rearwardly and is prepared for the next impact. The rearward travel of anvil plate 56 is limited by post 80 to maintain a gap between the neutral position of hammers 108, 108' and the anvil plate so that the resonant beams 87, 88 never reach a forced vibration mode.

The impact of resonant beams 87, 88 on anvil plate 56, driving the anvil plate and cutter blade assembly 42 forwardly, dislodges the earth 112 or other material in the path of cutting blade 40 (FIG. 4). Dislodged earth 112 is forced upwardly along the floor 32 of channel member 30. A conveyor 114 has an input end underlying the rear terminus of floor 32, and collect the material excavated by channel member 32 so that it does not immediately return to the trench.

While a preferred embodiment of the present invention has been illustrated in detail, it is apparent that modifications and adaptations of that embodiment will occur to those skilled in the art. However, it is to be expressly understood that such modifications and adaptations are within the spirit and scope of the present invention, as set forth in the following claims.

What is claimed is:

1. A resonantly driven tool for forming a trench in a base material such as earth, said tool comprising:

a channel member adapted to be aligned with the path of the trench to be formed and having a floor inclined upwardly toward the rear, oppositely disposed sides projecting upwardly from the floor, and being open at the front and having an opening toward the rear;

means for vertically adjustably supporting the channel member and advancing said member along the path of the trench to be formed;

a cutting blade assembly located at the leading end of the floor of the channel member and mounted for reciprocating motion relative to said leading end, said cutting blade assembly engaging the material in which the trench is to be formed as the channel member is advanced;

a resonant system having an output vibratory in at least near resonance and supported to move with the channel member; and an anvil plate reciprocatably mounted between said output of said resonant system and said cutting blade assembly so that said resonant system is able to drive the cutting blade assembly intermittently forwardly to dislodge the material so that the dislodged material is excavated by the channel member.

2. The tool of claim 1 wherein said anvil plate is reciprocatably mounted parallel to the floor of the channel member and has a leading end proximate the cutting blade within striking distance thereof and a trailing end within striking distance of the output of the resonant system.

3. The tool of claim 2 wherein the anvil plate includes means for establishing and maintaining a gap between the neutral position of the output of the resonant system and the trailing end of the anvil plate at the rearwardmost position of the cutting blade so that operation of the resonant system in a forced vibration mode is avoided when the cutting blade encounters an obstacle.

4. The tool of claim 1 wherein the resonant system comprises a pair of resonant beams fixed to the outside surfaces of the respective sides of the channel member.

5. The tool of claim 1 wherein the resonant system comprises at least one angle beam having a pair of legs meeting at a juncture at an angle of approximately 90°, and having a resonant frequency, when restrained at the juncture, with a node at the juncture and anti-nodes at the ends of the respective legs, one said anti-node being said output.

6. The apparatus of claim 5 and comprising a pair of such angle beams mounted to the outside surfaces of the respective sides of the channel member.

7. The tool of claim 1 wherein said supporting means comprises a frame mounted to a mobile vehicle, said frame including means for adjusting the vertical position of the channel member to control the depth of the trench.

8. A resonantly driven tool for forming a trench in a base material such as earth, said tool comprising:

a channel member adapted to be aligned with the path of the trench to be formed and having a floor inclined upwardly toward the rear, oppositely disposed sides projecting upwardly from the floor, and being open at the front and having an opening toward the rear;

means for supporting the channel member and advancing said member along the path of the trench to be formed;

a cutting blade assembly located at and spanning the leading end of the floor of the channel member and mounted for reciprocating motion relative to said leading end, said cutting blade assembly engaging the material in which the trench is to be formed as the channel member is advanced;

an anvil plate reciprocatably mounted beneath the floor of the channel member and having a leading end proximate the cutting blade assembly within striking distance thereof and a pair of tongues projecting upwardly beyond the sides of the channel member, each said tongue having a rear striking surface; and a pair of resonant beams vibratory in at least near resonance and having output ends within striking distance of the striking surfaces of the anvil plate so that said output ends impact the anvil plate and drive the plate against the cutting blade assembly to drive the cutting blade assembly intermittently forwardly to dislodge the material so that the dislodged material is excavated by the channel member.

9. The tool of claim 8 wherein the channel member is open at the rear.

10. The tool of claim 9 and additionally comprising a conveyor having an input end at the rear of the channel member to receive material excavated thereby.

11. A resonantly driven tool for forming a trench in a base material such as earth, said tool comprising:

a channel member adapted to be aligned with the path of the trench to be formed and having a floor inclined upwardly toward the rear, oppositely disposed sides projecting upwardly from the floor, and being open at the front and at the rear;

a mobile frame adapted to support the channel member and advance said channel member along the path of the trench to be formed;

a cutting blade assembly located at and spanning the leading end of the floor of the channel member and mounted for reciprocating motion relative to said leading end, said cutting blade assembly engaging the material in which the trench is to be formed as the mobile frame moves forwardly;

an anvil plate reciprocatably mounted beneath the floor of the channel member and having a leading end proximate the cutting blade assembly within striking distance thereof and a pair of tongues projecting outwardly beyond the sides of the channel member, each said tongue having a rear striking surface;

a pair of resonant angle beams each including a pair of legs meeting at a juncture at an angle of approximately 90°, said resonant beams being mounted to the exterior of the respective sides of the channel member and each having a node at the juncture, an input at one end of one of the legs and an output at the end of the other leg within striking distance of the striking surfaces of the respective tongues of the anvil plate so that the outputs impact the anvil plate and drive the plate against the cutting blade assembly to drive the cutting blade assembly intermittently forwardly to dislodge the material, the dislodged material being scooped up by the channel member so that it passes along the floor of the channel member to the rear thereof; and a conveyor having an input end at the rear of the channel member to receive the dislodged material passing through the channel member.

12. The tool of claim 2, 8 or 11 wherein the anvil plate is mounted below the floor of the channel member on transverse rollers allowing forward and rearward reciprocating motion of the anvil plate.

13. A resonantly driven tool for forming a trench in a base material such as earth, said tool comprising:

a channel member adapted to be aligned with the path of the trench to be formed and having a floor inclined upwardly toward the rear, oppositely disposed sides projecting upwardly from the floor, and being open at the front and having an opening toward the rear;

means for supporting the channel member and advancing said member along the path of the trench to be formed;

a cutting blade assembly located at the leading end of the floor of the channel member and mounted for reciprocating motion relative to said leading end, said cutting blade assembly engaging the material in which the trench is to be formed as the channel member is advanced;

a resonant system having an output vibratory in at least rear resonance and supported to move with the channel member; and an anvil plate reciprocatably mounted parallel to the floor of the channel member and having a leading end proximate the cutting blade within striking distance thereof and a trailing end within striking distance of the output of the resonant system.

14. A resonantly driven tool for forming a trench in a base material such as earth, said tool comprising:

a channel member adapted to be aligned with the path of the trench to be formed and having a floor inclined upwardly toward the rear, oppositely disposed sides projecting upwardly from the floor, and being open at the front and having an opening toward the rear;

means for supporting the channel member and advancing said member along the path of the trench to be formed;

a cutting blade assembly located at the leading end of the floor of the channel member and mounted for reciprocating motion relative to said leading end, said cutting blade assembly engaging the material in which the trench is to be formed as the channel member is advanced;

a resonant system having an output vibratory in at least near resonance and supported to move with the channel member, said resonant system comprising at least one angle beam having a pair of legs meeting at a juncture at an angle of approximately 90°, and having a resonant frequency, when restrained at the juncture, with a node at the juncture and anti-nodes at the ends of the respective legs, one said anti-node being said output; and means for operatively coupling the output of the resonant system to the cutting blade assembly to drive the cutting blade assembly intermittently forwardly to dislodge the material so that the dislodged material is excavated by the channel member.

15. The tool of claim 13 or 14 wherein said supporting means comprises a frame mounted to a mobile vehicle, said frame including means for adjusting the vertical position of the channel member to control the depth of the trench.

16. The tool of claim 13 or 14 wherein the channel member is open at the rear.

* * * * *